US006631833B2

(12) United States Patent
Harriman et al.

(10) Patent No.: US 6,631,833 B2
(45) Date of Patent: Oct. 14, 2003

(54) OVAL-SHAPED TUBE CLOSURE

(75) Inventors: Ron E. Harriman, Montebello, CA (US); Edward F. Csaszar, Mountainside, NJ (US)

(73) Assignee: CCL Container Corporation, Chester, PA (US)

( * ) Notice: Subject to any disclaimer, the term of this patent is extended or adjusted under 35 U.S.C. 154(b) by 0 days.

(21) Appl. No.: 09/784,900

(22) Filed: Feb. 16, 2001

(65) Prior Publication Data

US 2002/0113097 A1 Aug. 22, 2002

(51) Int. Cl.[7] ..... B67D 3/00
(52) U.S. Cl. ..... 222/536; D9/449
(58) Field of Search ..... D9/449, 450; 222/531, 222/536, 556

(56) References Cited

U.S. PATENT DOCUMENTS

| | | | | | |
|---|---|---|---|---|---|
| 4,013,200 | A | * | 3/1977 | Tripp | 222/536 |
| 4,742,928 | A | | 5/1988 | Braun | 215/235 |
| 4,776,501 | A | | 10/1988 | Ostrowsky | 222/517 |
| D316,221 | S | | 4/1991 | Dombroski | D9/302 |
| 5,123,561 | A | | 6/1992 | Gross | 220/254 |
| 5,392,968 | A | | 2/1995 | Dark | 222/529 |
| D363,222 | S | * | 10/1995 | Lay | D9/449 |
| 5,503,309 | A | * | 4/1996 | Oder et al. | 222/556 |
| D374,625 | S | | 10/1996 | Flurer et al. | D9/542 |
| 5,632,420 | A | * | 5/1997 | Lohrman et al. | 222/212 |
| D405,693 | S | | 2/1999 | Bretz et al. | D9/447 |
| 5,988,425 | A | * | 11/1999 | Yehl et al. | 220/303 |
| D426,158 | S | * | 6/2000 | Flurer et al. | D9/449 |
| 6,325,252 | B1 | * | 12/2001 | Brozell et al. | 222/536 |

* cited by examiner

*Primary Examiner*—Kenneth Bomberg
(74) *Attorney, Agent, or Firm*—Lerner, David, Littenberg, Krumholz & Mentlik, LLP

(57) ABSTRACT

A dispensing closure is provided for attachment to the discharge port of a standard circular-headed tube. The closure comprises a skirt with a circular cross-sectional shape at its base that merges gradually to an oval-shaped face at its top. When the closure is attached to a standard circular-headed tube, with the long axis of the oval face oriented substantially parallel to the straight crimped edge of the filled tube, the combination of closure and tube appears to the ordinary observer to have a continuously oval cross-sectional shape throughout the length of the combination. The dispensing closure can be manufactured using typical injection-molding techniques, and may be adapted for use with dispensing mechanisms and attachment means known in the personal care products industry.

11 Claims, 8 Drawing Sheets

OVAL-SHAPED TUBE CLOSURE

BACKGROUND OF THE INVENTION

This invention relates to closures for containers, more particularly to closures that produce unique visual effects when combined with standard containers for personal care products.

A variety of dispensing packages and containers have been developed for personal care products such as shampoos, lotions, etc., as well as for other materials. It is highly desirable that these dispensing containers be not only functional, but also have an aesthetic and distinctive appearance to attract the purchaser's eye and identify the product.

Numerous examples of containers and dispensing closures that are both functional and visually distinctive are found in the prior art. The examples presented herein are representative of such articles, and are relevant to the disclosure of the present invention.

U.S. Design Pat. No. 374,625 to Flurer et al. discloses a combined container and cap for a hair care product. The bottle has a distinctive narrow oval shape that is continued by the pushbutton-style cap. The cap has a constant oval cross-section from the base of its skirt to its top, and a ring-shaped ornament around its base where the base meets the shoulder of the bottle. U.S. Design Pat. No. 426,158, also to Flurer et al., presents a more detailed disclosure of the cap.

U.S. Design Pat. No. 405,693 to Bretz et al. presents a bottle closure with a circular skirt and a non-circular top. The top appears as an oval when viewed from above. The cross-sectional shape changes suddenly from round to oval rather than gradually merging from one shape to the other.

U.S. Pat. No. 5,392,968 to Dark discloses a closure in FIGS. 12 and 13 in which the skirt has a circular cross-section and the top has a non-circular cross-section that is approximately oval in shape. Again, the closure does not exhibit a smooth transition from the base of the skirt to the top portion thereof.

U.S. Design Pat No. 363,222 to Lay discloses a dispensing container with a pushbutton dispensing mechanism where the skirt and top each have oval faces of slightly different shape. As a result, when viewed from the side, the closure has a vertical wall adjacent to the outlet port of the dispenser and a wall that is sloped slightly off vertical adjacent to the button end of the dispenser.

U.S. Design Pat. No. 316,221 to Dombroski discloses a design for an oval collapsible tube and a cap therefor. The sleeve of the tube has an oval head and, therefore, an oval cross-section throughout its length, and the cap has an oval face of substantially the same shape and cross-sectional area as the oval head of the tube.

U.S. Pat. No. 4,013,200 to Tripp presents a dispensing closure having a circular skirt and an oval top. The cross-section expands continuously from the skirt to the top so that the cross-sectional area of the oval top is substantially larger than the area described by the skirt.

A variety of dispensing mechanisms are also known in the art. A typical pushbutton-type dispensing closure is disclosed in U.S. Pat. No. 4,776,501 to Ostrowsky. In general, a pushbutton-type closure is characterized by an actuator that rotates about a pair of pivots secured within the body of the closure. An effluent duct within the actuator is fluidly connected to the interior of the container when the closure is in its open position. When the actuator is in its closed position, the effluent duct is concealed.

U.S. Pat. No. 5,123,561 to Gross discloses a flip-top closure similar to a generic closure used in the personal care products industry. The body of the closure comprises a checkboard that is perforated to provide a fluid connection between the interior of the container and the outside of the closure. A lid is connected to the skirt of the closure by means of a hinge, and a plug on the underside of the lid is positioned to block the opening when the lid is in its closed position.

U.S. Pat. No. 4,742,928 to Braun discloses a variation of the flip-top cap where the lid is attached to the closure body by means of a pivot mechanism.

Various means of attaching a closure to a receptacle are also known in the art. Two widely used means are the threaded screw-on connection, exemplified in U.S. Pat. No. 4,742,928 and the snap-on fitting, exemplified in U.S. Pat. No. 5,123,561, which locks the closure in position on the receptacle. A variation of the snap-on fitting, the bayonet fitting, also locks the closure onto the receptacle but is easier to remove and replace.

It is desirable to be able to manufacture a dispensing tube which has the appearance of having an oval head. Dispensing tubes typically are made with circular heads and circular closures, thereby producing packages with a generally circular appearance. In comparison, dispensing tubes with oval heads and oval closures are relatively unusual and therefore visually distinctive.

The vast majority of plastic tube manufacturing machines in use today are designed and tooled to make tubes with circular heads, rather than oval heads. The standard process of making a plastic tube involves the following steps: (1) extruding a plastic sleeve; (2) compression-molding a circular tube head onto the plastic sleeve; (3) decorating the tube; and (4) attaching a closure to the tube. Subsequently, the tube is filled with product through its open end, which is then crimped to seal the tube.

The methods of making and using a tube with an oval head are more complex and costly than the method used with circular heads. For example, the tube may be made directly using the same steps as are used with a circular head, except that an oval head is compression-molded onto the tube instead of the circular head. While feasible, this approach requires the purchase of an expensive oval-heading tool, with a cost of about $100,000 per diameter, and the purchase of specialized oval decorating mandrels instead of the more common circular mandrels. An existing production line must be changed over from round to oval in its entirety to change the type of tube being made. In another approach, the sleeve is decorated before the oval tube head is compression-molded onto the sleeve. Again, this production variation requires equipment modifications and the purchase of special tooling, and requires the production line to be changed from round to oval. There is also a risk of damaging the decoration on the sleeve due to the elevated temperatures and compression force involved in the compression-molding process. A third, and less desirable approach, is to manufacture a tube with a circular head following the process discussed herein, cut off the circular head, and weld on an oval tube head in a secondary process. This method suffers from the requirement for a secondary manufacturing step as well as from wastage of materials.

It is desirable to develop a dispensing closure that, when combined with a standard tube having a circular head, creates the distinctive visual impression of a dispensing tube having an oval head and closure. This would allow the use of commonly available equipment for tube decorating and compression-molding, and the much less complex and relatively inexpensive manufacturing process used to make circular-headed tubes. It would also be advantageous if such a closure could be adapted for use with the various dispensing mechanisms and attachment fittings that are currently known throughout the packaging industry.

SUMMARY OF THE INVENTION

A dispensing closure is provided for a container for flowable material. The shape of the closure is defined by an external skirt which has a circular cross-sectional shape at its base that merges gradually to an oval-shaped face at the top of the closure. When combined with a standard circular-headed dispensing tube, the combination of this "round-to-oval" closure with the circular-headed tube appears to an ordinary observer to have oval-shaped cross sections throughout its length, rather than appearing to be a circular closure mounted to a circular tube. The use of the disclosed closure in combination with the standard circular-headed tube allows fabrication of visually distinctive packages for creams, lotions or other items typically packaged in dispensing tubes without the costs and wastage associated with fabricating oval-shaped tubes and closures.

In a preferred embodiment, the closure comprises a skirt forming the outer surface of the closure, where the skirt has a circular cross-sectional shape at its lower edge and forms an oval-shaped face at its top. The shapes of successive cross-sections of the skirt vary continuously along the length of the closure from the circular cross-sectional shape of the lower edge of the skirt to the oval-shaped face at the upper edge of the skirt. The closure further comprises a body member having means for attachment to a discharge port on the tube and a dispensing assembly interfitted with the closure.

The closure may be adapted for use with a number of different dispensing mechanisms, particularly, the push-button type and flip-top type of dispensing mechanism, or other dispensing mechanisms used in the personal care packaging industry. The means for attaching the closure body to the receptacle may be of a threaded screw-on type, a snap-on or bayonet type, or other means for attaching closures to containers that are known in the art.

The closure can be manufactured by well-known injection-molding techniques, preferably using polyolefin material, most preferably, polypropylene or a high-density polyethylene.

In another preferred embodiment, the "round-to-oval" closure is combined with a standard circular-headed tube. The tube comprises a cylindrical sleeve having an open end and a closed end, said sleeve typically having the form of a right circular cylinder. The closed end of the tube is formed by a circular head molded onto the circular sleeve. The circular head also has a discharge port molded onto it. The "round-to-oval", closure is attached to the discharge port of the tube so that the long axis of the oval face is substantially parallel to the straight edge formed by the crimped end of the tube. This combination of closure and tube appears to the ordinary observer to have a continuous cross-sectional oval shape throughout its length. This creates a distinctive visual impression of an oval tube at a substantially lower cost than would be incurred to manufacture an oval-headed tube and corresponding oval cap.

The impression of an oval-headed tube can be enhanced by decorating the partially flattened faces that are formed when the open end of the tube is crimped.

DETAILED DESCRIPTION OF THE INVENTION

Figure 4A:
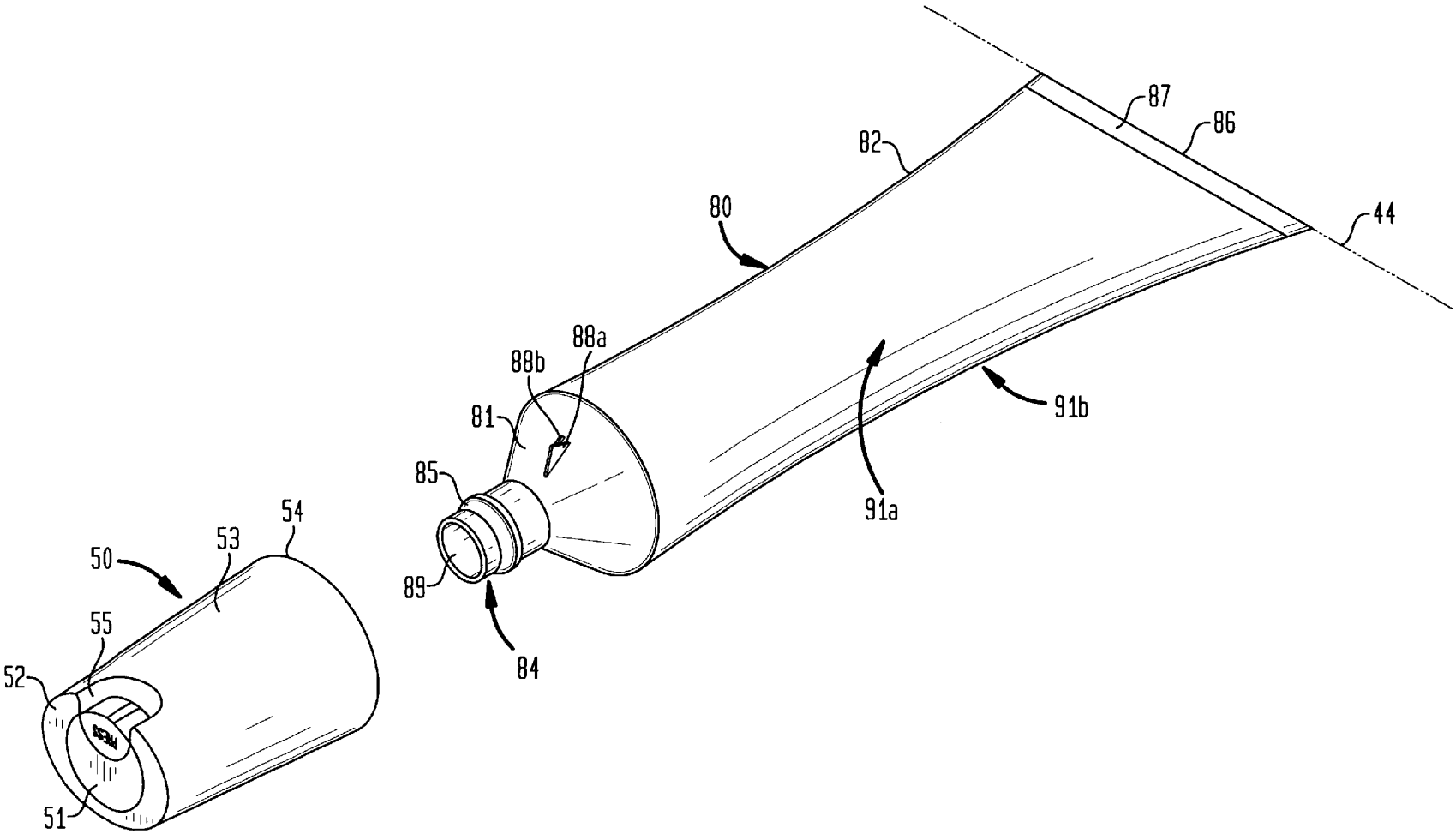
FIG. 4A is an exploded view of a preferred embodiment of the present invention.
Figure 4B:
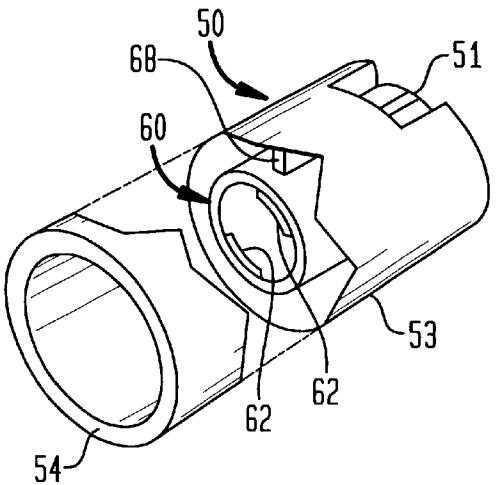
FIG. 4B is an exploded view of a preferred embodiment of the present invention.
Figure 4B:
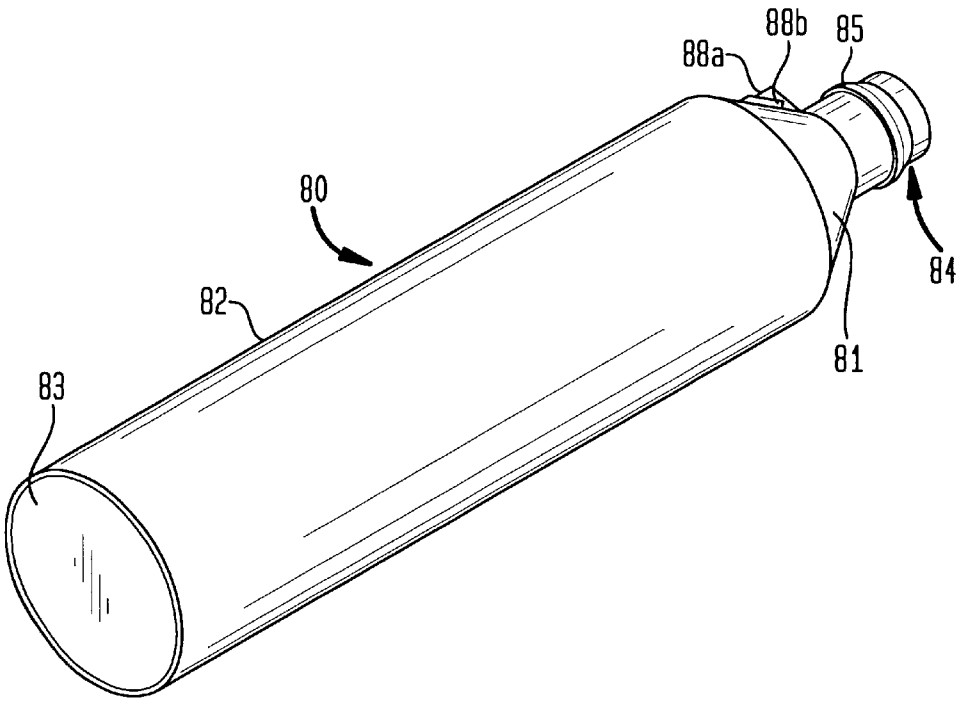

FIGS. 4A, 4B present exploded views of the preferred embodiment of the closure 50 in combination with a standard circular-headed tubular receptacle 80. In the embodiment of FIG. 4A, pushbutton-type closure 50 has a skirt 53 with a circular base 54 and an oval face 52 at its top. Actuator 51 is interfitted within oval face 52. Recess 55 is molded into skirt 53 to allow the adjacent end of actuator 51 to be conveniently depressed by the tip of a user's finger.

Closure 50 attaches to tubular receptacle 80 by means of a snap-on fitting 60. Tubular receptacle 80 comprises sleeve 82, circular head 81 and neck 84. Flange 85 is an annular structure protruding from the exterior of neck 84. Ribs 88*a*, 88*b* are provided on head 81 and serve to orient closure 50 with respect to tubular receptacle 80 and prevent rotation of closure 50 after it is secured to neck 84 of tubular receptacle 80. Head 81, neck 84, flange 85 and ribs 88*a*, 88*b* are formed as a single unit by compression-molding methods widely known in the art. Sleeve 82 is formed as a right circular cylinder in a separate process, then head 81 is compression-molded onto sleeve 82. Typically, a closure, such as closure 50, is then fitted and secured to tubular receptacle 80. Tubular receptacle 80 is filled with product in a separate process and sealed by forming crimp 87 at open end 83. Edge 86 of crimp 87 defines a segment of line 44.

FIG. 4B shows the combination of tubular receptacle 80 and closure 50 prior to filling tubular receptacle 80 and crimping sleeve 82. The structures visible within closure 50 are presented in more detail in FIG. 5B, discussed herein.

The closure and tube of the present invention may be manufactured using standard, low-cost techniques that are widely employed throughout the packaging industry. Preferably, closure 50 is formed by injection-molding a plastic material. More preferably, the plastic material is a polyolefin, with polypropylene and high-density polyethylene being the most preferred materials. For embodiments in which a multiplicity of pieces are comprised in the closure, the individual pieces are injection-molded separately and assembled to form the closure. Preferably, the component parts of tubular receptacle 80 are also made of plastic, more preferably vinyl or polyolefin, with polypropylene and high-density polyethylene being the most preferred polyolefin materials.

FIGS. 5A–5D show four views of the preferred embodiment of closure 50. Preferably, circular base 54 of skirt 53 has the same diameter as sleeve 82 so that when closure 50 is seated on tubular receptacle 80, the exterior of skirt 53 and the exterior of sleeve 82 give the impression of having a continuous surface. Oval face 52 has a long axis 41 and a short axis 42. Preferably, the length of oval face 52 along long axis 41 is substantially the same, but no greater than, the diameter 43 of circular base 54 of skirt 53. This creates the impression that skirt 53, when viewed from front or rear (FIG. 5C), forms substantially vertical side walls 56*a*, 56*b*. More preferably, the slopes of side walls 56*a*, 56*b* deviate no less than about 1% from vertical, and no more than about 2% from vertical. The length of oval face 52 along its short axis 42 is substantially smaller than its length along long axis 41. Actuator 51 is circular in shape and is embedded within oval face 52. Outer surface 51*a* of actuator 51 is level with oval face 52 as illustrated in rear view FIG. 5C and side view FIG. 5D. The short dimension of oval face 52 relative to diameter 43 of circular base 54 causes side walls 57*a*, 57*b* to slope inward from the vertical as illustrated in side view FIG. 5D. Recess 55 molded into skirt 53 exposes the rear of actuator 51 and allows actuator 51 to be conveniently depressed from the level closed to the sloped open position, with actuator 51 pivoting around axis of rotation 45, which is defined by pivots 72. Level closed and sloped open positions of an actuator are exemplified in FIGS. 1A, 1B.

Closure 50 is open at base 54 to allow access to attachment means 60 to secure closure 50 to tubular receptacle 80. Attachment means 60 comprises body member 61, and flanges 62 and ridges 63 which protrude from the interior wall of body member 61. Body member 61 is an annular structure attached to skirt 53 and the underside of oval face 52. Body member 61, flanges 62, and ridges 63 are adapted to cooperate with flange 85 of tubular receptacle 80 so that closure 50 may be attached to tubular receptacle 80 by positioning body member 61 over neck 84 and pushing closure 50 toward tubular receptacle 80 so that flanges 62 slide over flange 85, with the results that flanges 62 and ridges 63 fit snugly against flange 85 and that closure 50 may not be removed from tubular receptacle 80 absent application of considerably greater force than that required to slide flanges 62 over flange 85.

Figure 5B:
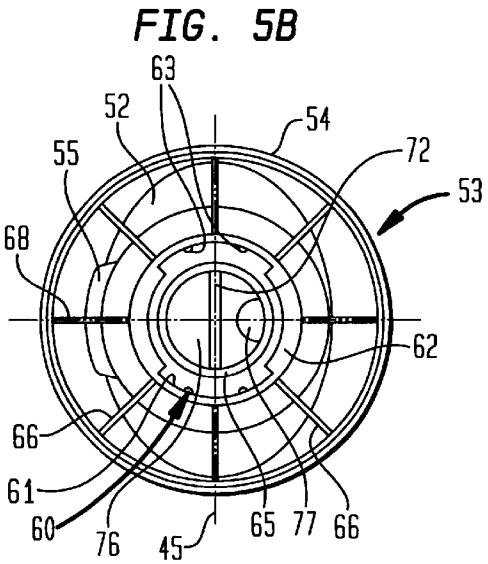
FIG. 5B is a bottom view of a preferred embodiment of the present invention.
Figure 5D:
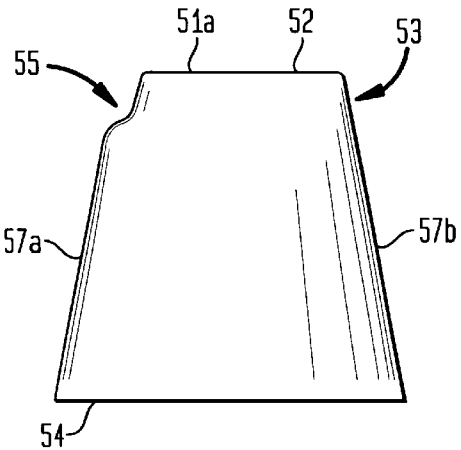
FIG. 5D is a side view of a preferred embodiment of the present invention.
Figure 5A:
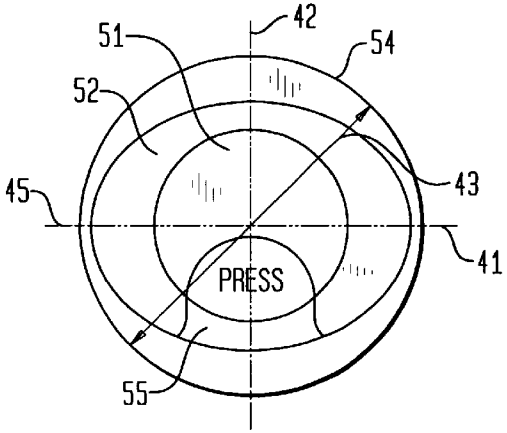
FIG. 5A is a top view of a preferred embodiment of the present invention.
Figure 5C:
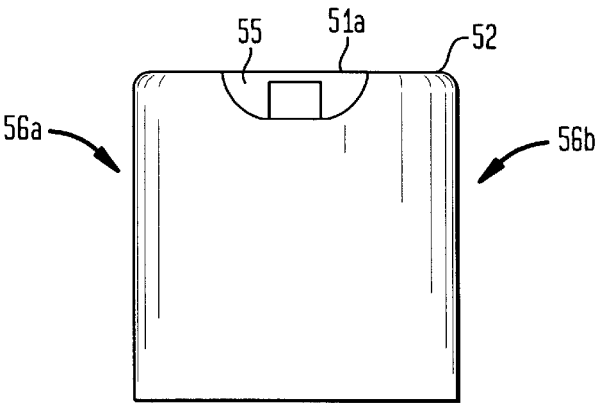
FIG. 5C is a rear view of a preferred embodiment of the present invention.

Ribs 66, 68 are molded integrally with skirt 53 and body member 61 and provide structural support for skirt 53. Positioning rib 68 serves the additional purpose of enabling closure 50 to be oriented with respect to tubular receptacle 80 through cooperation of positioning rib 68 with ribs 88*a*, 88*b* of tubular receptacle 80. FIG. 5B further illustrates the location of checkboard 76, pivots 72 and pipe 77 which are integral to a preferred pushbutton dispensing mechanism discussed herein. Actuator 51 pivots around axis of rotation 45 which, in the illustrated embodiment, is located within pivots 72. Axis of rotation 45 is substantially parallel to long axis 41 of oval-shaped face 52.

Figure 6:
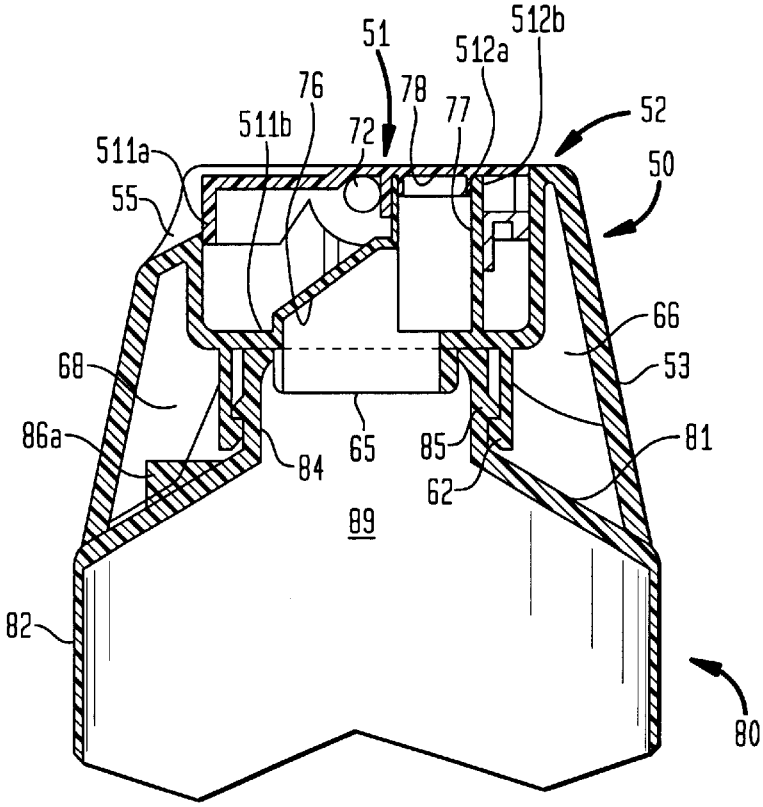
FIG. 6 is a left cross-sectional view of the embodiment of FIGS. 5A–5D.

FIG. 6 presents a cross-sectional view of a preferred combination of closure 50 and tubular receptacle 80 wherein closure 50 is attached to tubular receptacle 80. The cross-section of FIG. 6 is taken between rib 88*a* and rib 88*b* of tubular receptacle 80. In a preferred embodiment, body member 61 further comprises an annular structure 65 which serves to plug opening 89 of tubular receptacle 80.

The limits of the open sloped and level closed positions of actuator 51 are set by limiting means 511*a*, 511*b* and 512*a*, 512*b*, respectively. Actuator 51 pivots to its maximum sloped open position at which the rear lower edge 511*a* of actuator 51 contacts the base of checkboard 76, referenced as 511*b*. Movement of actuator 51 to its level closed position is limited by contact of portion 512*a* of inner surface 78 of actuator 51 against upper end 512*b* of pipe 77.

Figure 7:
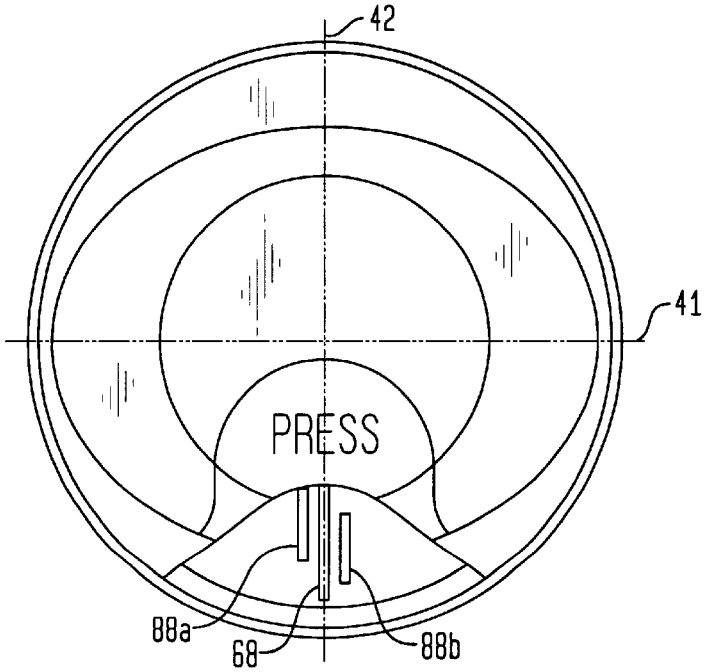
FIG. 7 is a cutaway top view of the embodiment of FIGS. 5A–5D.
Figure 8:
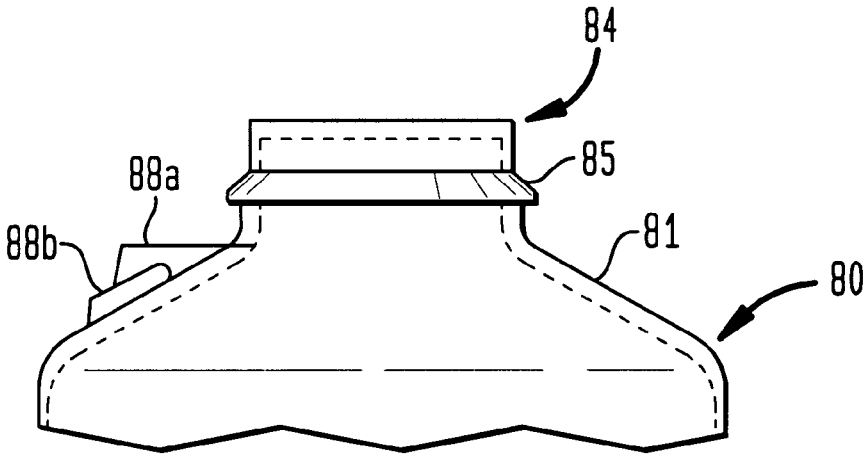
FIG. 8 is a fragmentary side view of a tubular receptacle known in the art.
Figure 9:
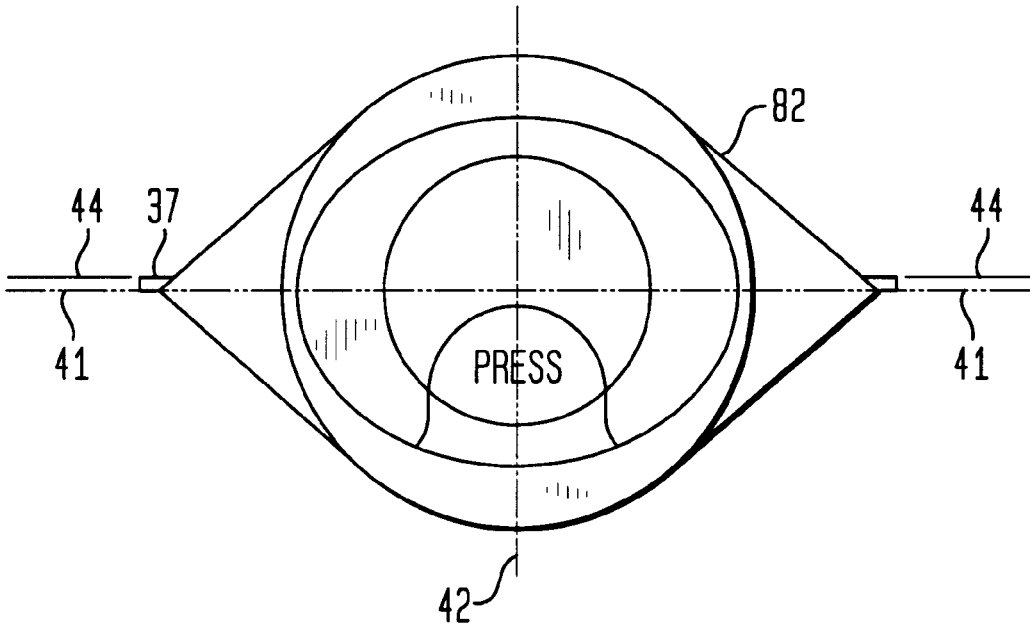
FIG. 9 is an end-on view of the preferred embodiment of FIG. 4A.

Cutaway top view FIG. 7 illustrates the location of ribs 88*a*, 88*b* and positioning rib 68 when closure 50 has been installed upon tubular receptacle 80. Positioning rib 68 extends sufficiently beyond body member 61 to contact ribs 88*a*, 88*b*, when closure 50 is attached to tubular receptacle 80, while ribs 66 end at a level substantially above ribs 88*a*, 88*b*, so as to avoid contact between ribs 66 and ribs 88*a*, 88*b*. Rib 88*a* extends substantially further above head 81 than rib 88*b* as seen in FIG. 8. To attach closure 50 to tubular receptacle 80, closure 50 is placed with body member 61 over neck 84 above flange 85. Closure 50 is rotated clockwise, as seen from the orientation of the top view of closure 50, until positioning rib 68 contacts rib 88*a*. Closure 50 is then pushed firmly toward tubular receptacle 80 until flanges 62 pass over flange 85 and snap into place, with a result that positioning rib 68 fits snugly between rib 88*a* and rib 88*b*. The snug fit locks closure 50 in position on tubular receptacle 80 with flanges 62 secured between flange 85 and tube head 81. Most preferably, positioning rib 68 and ribs 88*a*, 88*b* are positioned so that when open end 83 of tubular receptacle 80 is crimped, long axis 41 of oval face 52 is substantially parallel with line 44 (FIG. 9).

Figure 1A:
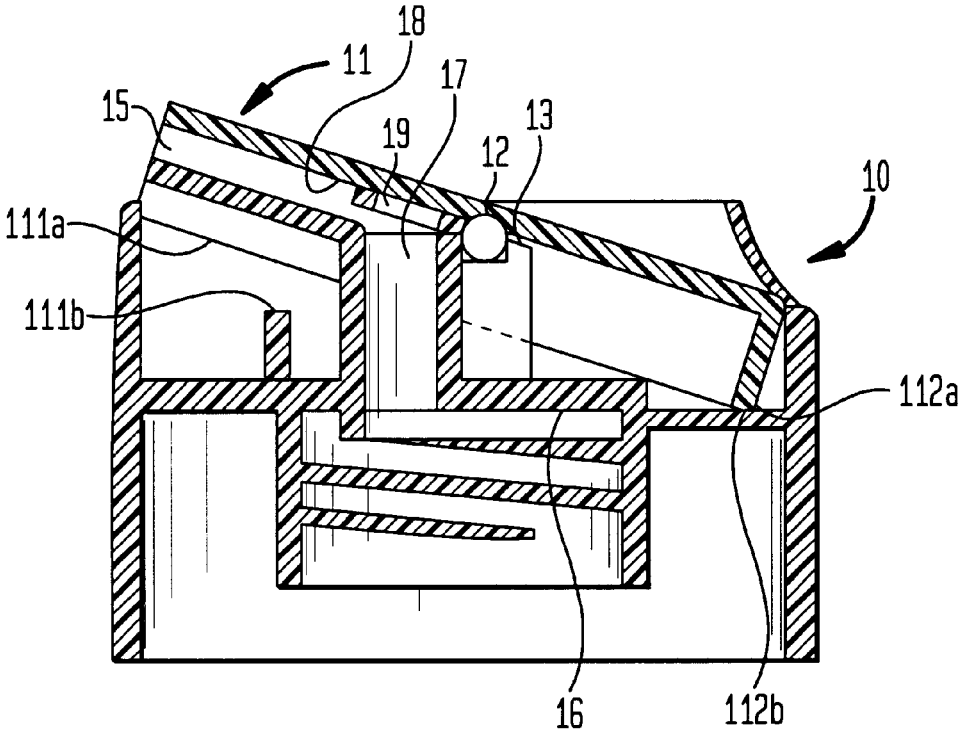
FIG. 1A is a cross-sectional view of a type of dispensing closure known in the art in its sloped open position.
Figure 1B:
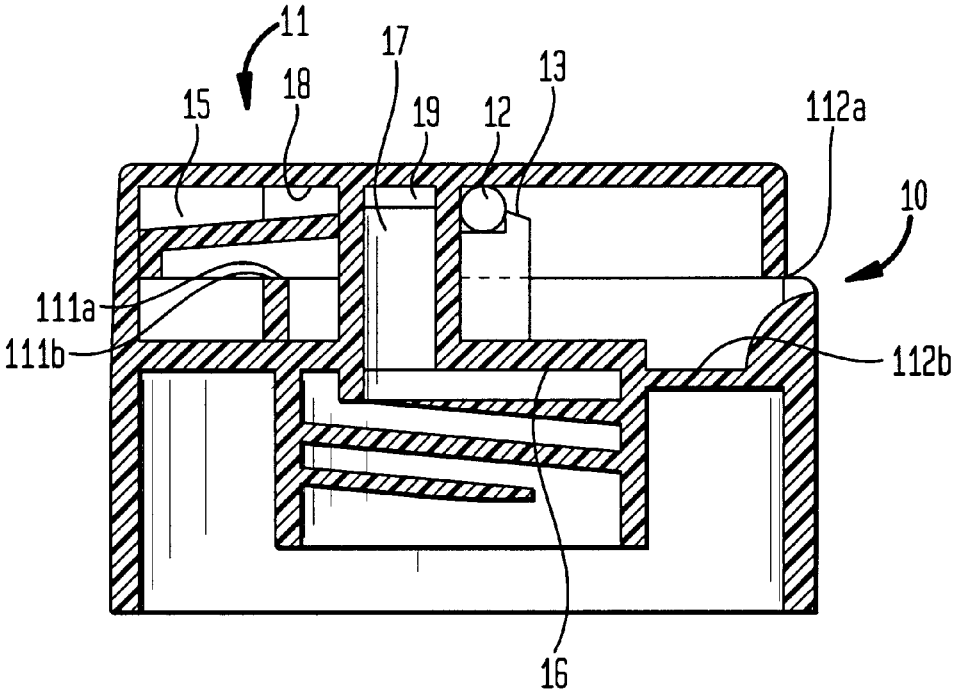
FIG. 1B is a cross-sectional view of dispensing closure of FIG. 1A in its level closed position.

As will be obvious to one skilled in the art, the "round-to-oval" skirt 53 is not limited to use with the pushbutton-type dispensing mechanism of the preferred embodiment. Various dispensing mechanisms known in the art may be adapted for use in the present invention. FIGS. 1A, 1B present a typical pushbutton-type dispensing closure 10 known in the art. The pushbutton-type closure 10 is characterized by actuator 11 having a pair of pivots 12 that are received and secured by securing means 13 within the body of the closure 10, so that actuator 11 pivots around an axis of rotation (not shown) defined by pivots 12. Movement of actuator 11 to its maximum open sloped position and its level closed position is limited by limiting means 111*a*, 111*b* and 112*a*, 112*b*, respectively. Actuator 11 pivots to its maximum sloped open position at which rear corner 112*a* of actuator 11 contacts the body of the closure at surface 112*b*. Movement of actuator 11 past its level closed position is limited by contact of section 111*a* of actuator 11 with structure 111*b*. Typically, there is an effluent duct 15 within actuator 11 which is exposed when actuator 11 is in a sloping open position (FIG. 1A) and covered when actuator 11 is in a level closed position (FIG. 1B). Checkboard 16 is present within the body of closure 10. Pipe 17 penetrates checkboard 16 and provides a fluid connection between effluent duct 15 and the interior of a container to which closure 10 is attached. Protruding plug 18 on inner surface 19 of actuator 11 is in position to block pipe 17 when actuator 11 is in its level closed position (FIG. 1B).

Figure 2:
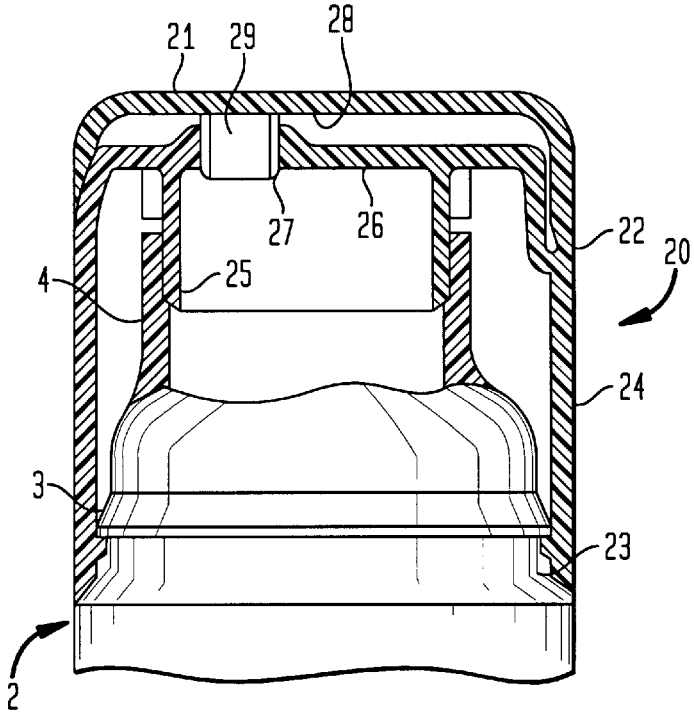
FIG. 2 is a cross-sectional view of a type of dispensing closure known in the art further illustrating a snap-on type attachment means.

FIG. 2 illustrates a typical flip-top closure 20 in cross-sectional view, attached to discharge port 4 of a section of receptacle 2. Checkboard 26 within the body of closure 20 faces the interior of receptacle 2. Checkboard 26 defines opening 25 which serves the same purpose as effluent duct 15 shown in FIG. 1A, 1B. Lid 21 is connected to skirt 24 of closure 20 by means of a web or thin-wall hinge 22. Plug 28 is positioned on the inner surface 29 of lid 21 so that it will seal opening 27 when lid 21 is in its level closed position. In this particular illustration, body member 25 of closure 20 is adapted to fit snugly within neck 4 of container 2, thereby acting as a plug. Closure 20 is secured to container 2 with a snap-on type fitting 3,23. Protruding flange 3, here shown as a ring continuous with the outer surface of the container 2, is molded along the perimeter of container 2. Flange 23 is molded onto closure 11 along the interior bottom edge of skirt 23. Both flange 23 within skirt 24 and ridge 3 on container 2 are adapted so that, when closure 20 is placed over neck 4 of container 2 and pressed toward container 2, flange 23 within skirt 24 slides over ring 3 molded onto container 2. Closure 20 is thereby secured to container 2 so that closure 20 can only be removed by applying a substantially greater force than was needed to secure it to container 2.

Figure 10:
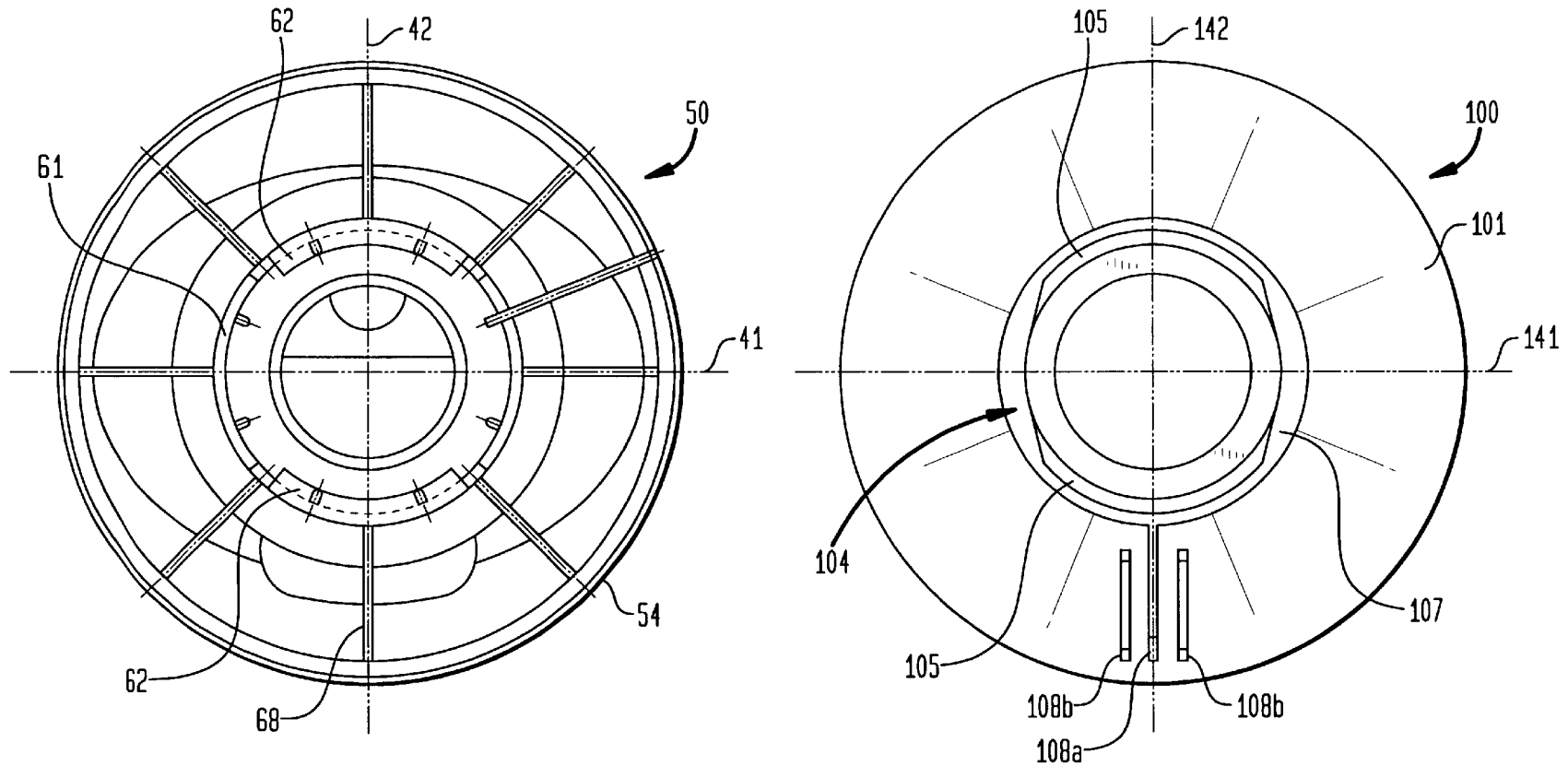
FIG. 10 is a side-by-side presentation of the bottom view of FIG. 5B with an end view of a tubular receptacle known in the art.

FIG. 10 illustrates the components of a bayonet fitting, which is a variation of the snap-on type fitting. Flanges 105 extend from opposing sides of neck 104, in contrast to flange 85 of FIGS. 4A, 4B, which is continuous around the circumference of neck 84. Axes 141 and 142 are defined as being parallel to axes 41 and 42, respectively, when closure 50 is positioned on tubular receptacle 100 with positioning rib 68 adjacent to rib 108. Cylinder member 61 and flanges 62 are adapted to cooperate with neck 104 and flanges 105 to releasably attach closure 50 to tubular receptacle 100. To releasably attach closure 50 to tubular receptacle 100, cylindrical member 61 is positioned over neck 104 so that axis 42 is substantially parallel to axis 141, i.e., closure 50 is displaced by 90° from its locked position. Closure 50 is then pushed toward tubular receptacle 100 until face 54 contacts tubular receptacle 100. Closure 50 and tubular receptacle 100, along with their components referenced on FIG. 10, are adapted so that flanges 62 will not contact flanges 105 while closure 50 is displaced by 90° from its locked position. Tubular receptacle 100 is shown as having three ribs, 108*a*, 108*b*. Rib 108*a* projects substantially further away from tubular receptacle 100 than either of ribs 108*b*. Closure 50 is rotated around neck 104 until positioning rib 68 slides over the nearest rib 108*b* to contact rib 108*a*. The snug fit of positioning rib 68 between ribs 108*a* and 108*b* locks closure 50 in position with flanges 62 secured between flanges 105 and collar 107. Closure 50 is removed from tubular receptacle 100 by rotating closure 50 around neck 104, causing positioning rib 68 to slide over rib 108*b*, to displace closure 50 by 90° from its locked position. Closure 50 is then conveniently removed from neck 104 without contacting flanges 62 against flanges 105.

Figure 3:
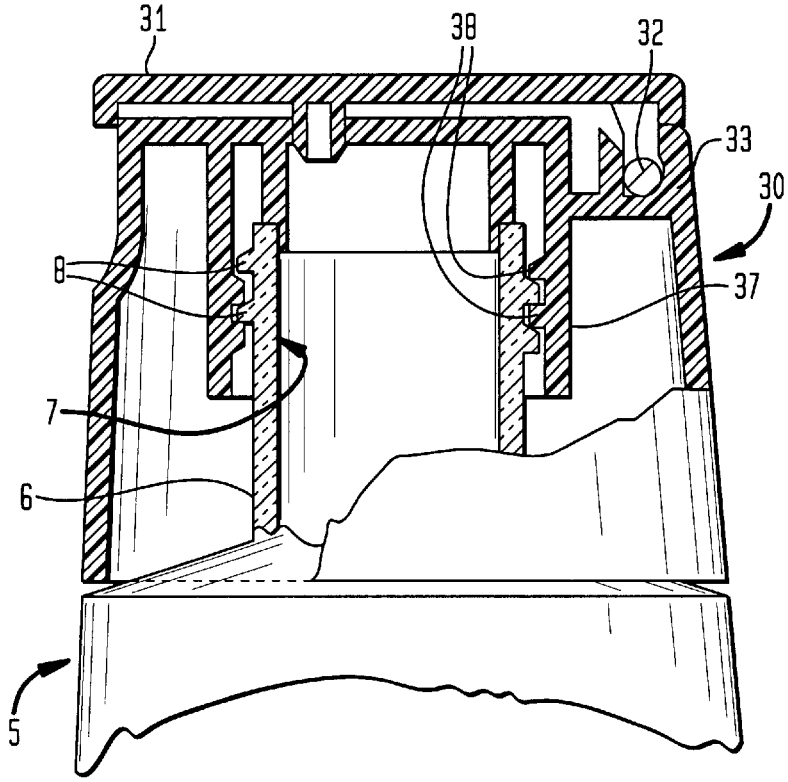
FIG. 3 is a cross-sectional view of a variation of the dispensing closure of FIG. 2 further illustrating a screw-on type attachment means.

FIG. 3 presents a variation of the flip-top closure of FIG. 2 attached to discharge port 6 on a section of receptacle 5. Lid 31 is attached to the body of closure 30 by means of a pair of pivots 32 integral to lid 31 and a means 33 of receiving and securing pivots 32 provided in the body of closure 30. FIG. 3 also illustrates a screw-on type means of attaching closure 30 to container 5. The screw-on type means comprises a threaded cylindrical member 37 within the body of closure 30 that is complementary to a threaded portion 7 of container 5. Closure 30 is attached to container 5 by positioning closure 30 over threaded portion 7 of container 5 so that threads 38 of closure 30 engage threads 8 of threaded portion 7 of container 5, and rotating closure 30 until it is seated on container 5.

It would be obvious to one skilled in the art that a threaded body member or bayonet-type attachment means could readily be substituted for the snap-on attachment means 60 of closure 50 without substantially modifying the injection-molding or assembly methods required for the present invention. Substitution of a threaded body member would also require that ribs 88*a*, 88*b* and positioning rib 68 be modified to allow closure 50 to be rotated into contact with head 81.

In a preferred embodiment of the present invention, the finished and filled tubular receptacle 80 is crimped at its open end 83 so that line 44, defined by edge 86 of crimp 87, is substantially parallel to long axis 42 of oval face 52. As is known throughout the art, and may be observed in FIG. 4A, the formation of the crimped end 87 deforms the circular shape of sleeve 82, resulting in formation of two partially flattened faces 91*a* and 91*b* (not visible in FIG. 4A) on opposing sides of tubular receptacle 80. The desired visual impression of a tubular receptacle and closure combination that is oval throughout its length may be enhanced by decorating one or both of the partially flattened faces 91*a*, 91*b*. Preferably, sleeve 82 is decorated before tubular receptacle 80 is filled and open end 83 is crimped. Therefore, decorations, most preferably, are applied in position on areas of sleeve 82 that will form partially flattened surfaces 91*a*, 91*b* when open end 83 is sealed by forming crimp 87. Decorations may be applied directly to the exterior of sleeve 82 or may be printed on labels which are then affixed to faces 91*a*, 91*b* of tubular receptacle 80. The actual methods used to decorate tubular packages are well known throughout the personal care packaging industry and do not form a part of this invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A dispensing closure for attachment to the discharge port of a receptacle comprising a skirt forming an outer surface of said closure and comprising a lower edge and an upper edge, said lower edge of said skirt forming a closure base defining an opening of said closure, said skirt having a circular cross-sectional shape at said closure base, and said upper edge of said skirt forming an oval-shaped face at the top of said closure wherein the shapes of successive cross-sections of said skirt vary continuously along the length of said closure from said circular-cross-sectional shape at said lower edge of said skirt to said oval-shaped face at said upper edge of said skirt;

a body member disposed within said skirt and comprising attachment means for attachment to said discharge port so that an interior face of said body member is exposed to the interior of said receptacle; and a dispensing mechanism interfitted within said body member.

2. The dispensing closure of claim 1 wherein said oval-shaped face has a long axis and a short axis and said circular cross-sectional shape of said closure base has a diameter, and said long axis is substantially the same length as said diameter.

3. The dispensing closure of claim 1 wherein said dispensing mechanism is of a pushbutton type comprising an actuator having an inner face and an outer face, said actuator being pivotally mounted to and interfitted within said body member so as to be pivotable between a level closed position and a sloped open position, said outer face of said actuator forming at least a portion of said oval-shaped face when said actuator is in said level closed position;

a checkboard within said body member mounted below said actuator, said checkboard comprising a pipe that penetrates said checkboard, said pipe having an upper port and a lower port;

said actuator comprising a protruding plug on said inner face of said actuator, said plug being in position to block said upper port of said pipe when said actuator is in said level closed position; and an effluent duct within said actuator, said effluent duct having a forward-opening port at one end of said actuator and a rear port at an opposing end of said actuator fluidly connected with said upper port of said pipe;

said forward-opening port of said effluent duct being exposed when said actuator is in said sloping open position and covered when said actuator is in said level closed position.

4. The dispensing closure of claim 1 wherein said dispensing mechanism is of an articulated flip-top type comprising a lid comprising an outer surface and an inner surface, said lid being pivotally mounted on said body member so as to be pivotable between a level closed position and an open position, said outer surface of said lid forming at least a portion of said oval-shaped face when said lid is in said level closed position; and a checkboard integral with said body member, said checkboard defining an opening through said checkboard;

said lid comprising a protruding plug, said protruding plug being in position on said inner surface to block said opening when said pivot lid is in said level closed position.

5. The dispensing closure of claim 3 wherein said actuator comprises pivot means integral to said actuator, said body member comprises receiving means for receiving said pivot means and permitting said pivot means to pivot around an axis of rotation, and a limiting means adapted to limit said pivoting of said actuator, and said oval-shaped face has a long axis and a short axis, said axis of rotation being substantially parallel to said long axis of said oval-shaped face.

6. The dispensing closure of claim 4 wherein said lid comprises pivot means integral to said lid, said body member comprises receiving means for receiving said pivot means and permitting said lid to pivot around an axis of rotation, and said oval-shaped face has a long axis and a short axis, said axis of rotation being substantially parallel to said long axis of said oval-shaped face.

7. The dispensing closure of claim 1 wherein said dispensing mechanism is of a hinged flip-top type comprising a lid comprising an outer surface and an inner surface, said lid being mounted on said body member so as to be pivotable between a level closed position and an open position, the outer surface of said lid forming at least a portion of said oval face when said lid is in said level closed position; and a checkboard integral with said body member, said checkboard defining an opening through said body member;

said lid comprising a protruding plug, said protruding plug being in position on said inner surface to block said opening when said lid is in said level closed position; and said oval-shaped face having a long axis and a short axis, wherein said lid is connected to said dispensing closure by a hinging means adapted to allow said lid to pivot around an axis of rotation and said axis of rotation is substantially parallel to said long axis.

8. The dispensing closure of claim 1 wherein said attachment means is of a screw-on type and wherein said discharge port comprises a threaded cylindrical wall, and said body member comprises a threaded cylindrical wall complementary to said threaded cylindrical wall of said discharge port whereby said dispensing closure may be securely attached to said discharge port by positioning said threaded cylindrical wall of said body member over said threaded cylindrical wall of said discharge port and rotating said closure so as to engage said threaded cylindrical walls with each other until said dispensing closure is securely attached to said discharge port.

9. The dispensing closure of claim 1 wherein said discharge port of said receptacle comprises at least one flange thereon, and wherein said attachment means comprises attachment means within said body member comprising a cylindrical portion which comprises securing means adapted to secure said body member to said receptacle through cooperation with said at least one flange on said receptacle.

10. The dispensing closure of claim 9 wherein said discharge port comprises a neck integrally formed with said receptacle and said at least one flange is an annular structure co-extensive with an outer surface of said neck, said securing means co-operating with said at least one flange whereby said body member may be secured to said receptacle by placing said body member over said neck and forcibly pressing said dispensing closure toward said receptacle thereby causing said attachment means to slide over said at least one flange, whereby said body member cannot be detached from said neck absent application of a substantially greater force than was applied to cause said attachment means to slide over said flange.

11. The dispensing closure of claim 9 wherein said discharge port comprises a neck integrally formed with said receptacle and said at least one flange comprises at least two flanges protruding from an outer surface of said neck, said securing means cooperating with said at least two flanges whereby said body member may be removably secured to said receptacle by placing said body member onto said neck in a position whereby said attachment means do not contact said at least two flanges, and rotating said dispensing closure around said neck to a position whereby said attachment means is positioned between at least one of said at least two flanges and receptacle.

* * * * *